United States Patent [19]

Zahner et al.

[11] 4,278,358

[45] Jul. 14, 1981

[54] TYPE CARRIER WITH IMPRESSION CONTROL FORMATION

[75] Inventors: Peter Zahner, Schwabhausen; Diethelm Puch, Nurnberg, both of Fed. Rep. of Germany

[73] Assignee: Triumph Werke Nurnberg A.G., Nurnberg, Fed. Rep. of Germany

[21] Appl. No.: 56,057

[22] Filed: Jul. 9, 1979

[30] Foreign Application Priority Data

Jul. 14, 1978 [DE] Fed. Rep. of Germany ..... 2831009

[51] Int. Cl.[3] ..... B41J 1/30

[52] U.S. Cl. ..... 400/144.2; 400/174; 400/166; 101/93.03

[58] Field of Search ..... 400/144.1–144.4, 400/157.3, 166, 167, 174, 175; 101/93.02, 93.03

[56] References Cited

U.S. PATENT DOCUMENTS

| | | | |
|---|---|---|---|
| 3,574,326 | 4/1971 | Koehn | 400/144.3 |
| 4,119,384 | 10/1978 | Keiter | 400/144.2 |

OTHER PUBLICATIONS

*IBM Tech. Disc. Bulletin,* J. E. Drejza, vol. 19, No. 2, Jul. 1976, pp. 443–444.

*Primary Examiner*—Paul T. Sewell
*Attorney, Agent, or Firm*—Joseph R. Spalla

[57] ABSTRACT

A daisy wheel print element provided with hammer energy absorbing formations to obtain substantially uniform print density for different print area types.

3 Claims, 5 Drawing Figures

Fig_1
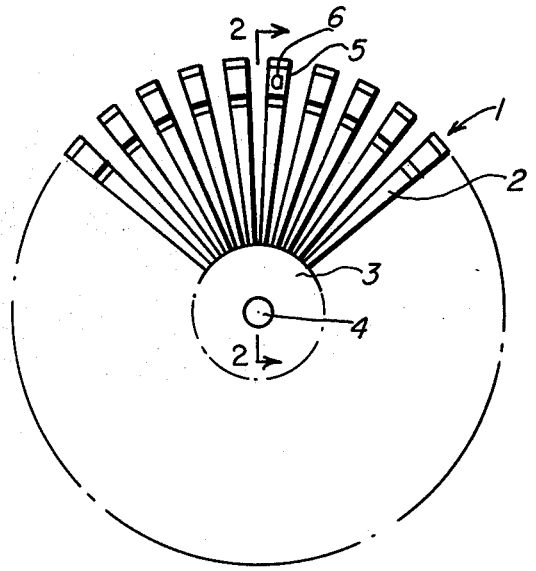
Fig_2
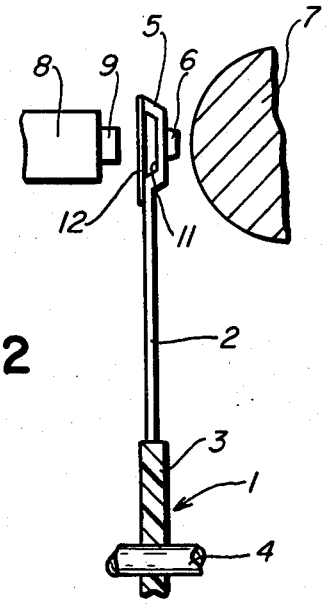
Fig_3
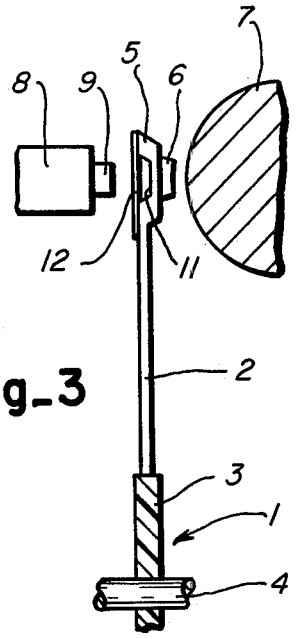
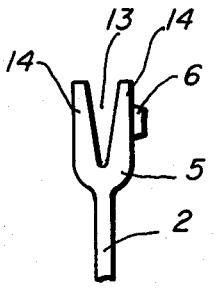
Fig_4
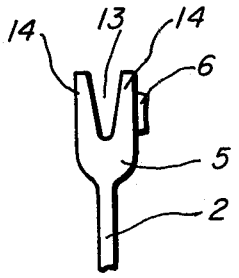
Fig_5

TYPE CARRIER WITH IMPRESSION CONTROL FORMATION

This invention relates to a single element print wheel having flexible character bearing radial spokes arranged and positionable about a common center to present a selected character opposite a hammer; more particularly it relates to a single element print wheel wherein each radial spoke has an energy absorbing formation opposite the hammer; and specifically it relates to a single element print wheel wherein the energy absorbing formations determine the impact force to be imparted according to the print area of a character.

In that types have different print areas, e.g. the large area "M" and the small area ".", impact forces imparted to each must be different to obtain uniform print density. In many systems which employ a hammer to drive a type to print, the driving force of the hammer is regulated in accordance with the type to be printed which is sensed from a memory as in U.S. Pat. No. 3,358,509 or from the print wheel itself as in German DE-OS No. 2,545,311 and DE-OS No. 2,614,801.

To avoid the relatively complex solutions of the prior art, the present invention regulates impact forces imparted to a type by providing hammer energy absorbing formations on the type carrier. The energy absorbing characteristic of each formation is a function of the print area of the types on the type carrier.

An object of the invention is to provide a simple mechanical impact regulating mechanism integrally formed with a type carrier.

Another object of the invention is in the provision of a print wheel having resiliently supported type to be driven by a constant energy hammer and energy absorbing formations for absorbing different amounts of energy according to the print area of type to be printed.

A further object of the invention is in the provision of hammer energy absorbing formations on a print wheel for regulating the impact force of type according to the print area of type to obtain uniform print density for all different print area types.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a front view of a single element type carrier in the form of a type wheel;

FIG. 2 is an enlarged cross-sectional view taken along lines 2—2 of FIG. 1 showing a small area character type at the end of a type wheel spoke with an associated hammer energy absorbing formation for regulating the impact force thereto;

FIG. 3 is a view similar to FIG. 2 showing a large area character type and an associated hammer energy absorbing formation; and FIGS. 4 and 5 are partial side views of small and large area character types with another embodiment of hammer energy absorbing formations to regulate print density.

Referring now to the drawing wherein like reference numerals designate like or corresponding parts throughout the Figures, there is shown in FIG. 1 a type wheel generally designated by reference numeral 1 consisting of individual flexible spokes 2 radially extending from a common hub 3 which is mounted on a shaft 4 supported on a printing carriage, not shown. At each of the free ends of the spokes 2, a character type body 5 with a type 6 thereon is formed. The types 6 to be printed are brought into printing position by rotation of the shaft 4 and print wheel 1 in known manner, e.g. by means of a stepping or servo motor, to position a selected type body 5 opposite a record carrier (not shown) trained about a platen 7 in front of which the printing carriage supporting the type wheel 1 is relatively displaceable in letter feed and carriage return directions. The printing of a type 6 whose type body 5 is positioned for printing in front of the platen 7 occurs by means of a constant energy printing hammer 8 actuated, for example, by an electromagnet (not shown) to drive its impact end 9 axially toward the positioned type body 5.

As is illustrated in FIGS. 2 and 3, the character type bodies 5 on the ends of spokes 2 have hammer energy absorbing formations comprising recesses 11 on the sides opposite the types 6 and the impact end 9 of the printing hammer 8. The recesses 11 preferably extend in the longitudinal direction of the type spokes 2. The energy absorbing formations also comprise a spring element 12 associated with each recess 11. The spring elements 12 are, for example, in the shape of a leaf spring fastened at one end either to the type body 5 or to its supporting spoke 2 to cover or overlap the recess 11 in the type body 5, thereby to flex to an extent permitted by the recess 11 and to selectively absorb the impact energy of the hammer 8. As shown in FIGS. 2 and 3, the size of the various recesses 11 determines the effective spring length and hence the spring characteristic and/or the magnitude of the flexure which is related to the surface area of a type 6, or to the printing impact force to be imparted to a type 6. Types 6 of small surface area (FIG. 2) which require smaller impact force are associated with larger recesses 11 and a larger effective spring length, and types of large surface area (FIG. 3) which require larger impact force are associated with smaller recesses 11 and with smaller effective spring lengths. Thus, in that the recess leaf spring formations absorb from the hammer 8 more or less energy during printing of the respective type, the printing energy adapted to a particular type area is achieved according to its effective spring length and/or by a greater or lesser flexure according to its spring characteristic.

Thus, the required printing energy to obtain uniform print density can be achieved by controlling the size of the recess 11 and selecting a spring 12 within the proper associated spring constant according to type area.

In another embodiment of the invention, the hammer energy absorbing formations, to obtain different impact forces of the various type 6, take the form of a V-notch 13 in the type body 5 which is open toward the periphery of the type wheel 1 and thus forms an elastic pair of legs 14 which is resilient in the direction of the strike of hammer 8. The size of notch 13 depends on the print area of a type 6, or respectively, on the desired printing strength of the type 6 associated with the type spoke 2, namely, in the case of small area type 6 (FIG. 4), the notch 13 is greater and in the case of large area type 6 (FIG. 5), the notch 13 is smaller. Accordingly, in the case of a larger notch 13, more printing energy is absorbed, or respectively, less printing force is built up than in the case of a smaller notch 13. Thus, printing energy is adapted to the print area of a type, or respectively, to the desired printing strength to be imparted to the type 6.

Similarly, as with the recess and spring formation, the printing energy can be further tailored in addition to the size of the notch by selection of the spring characteristic of the elastic legs 14.

The invention is usuable not only for regulating the impact force according to the individual type to create a uniform print density, but similarly also to grade certain types 6 or type groups as to printing strength in relation to others, more particularly to emphasize them.

The invention is not limited to printing element of the print wheel type, but can be used to equal advantage also in printing units wherein type is supported on any flexible carrier and impacted by a hammer.

Thus, in accordance with the invention, printing energy can be determined exclusively by means of energy absorbing formations on the type carrier. The advantage of this is that when exchanging one type carrier for another on which the types 6 are arranged differently, uniform print density is automatically provided without the necessity to change electronic controls.

The invention claimed is:

1. In combination, a print wheel having a plurality of flexible radial spokes extending from a common center, said spokes on one side adjacent the ends thereof carrying types of varying print area, and an axially moveable constant energy print hammer for impacting a positioned spoke on the side directly opposite the type carrying side to effect printing, the improvement comprising a resilient energy absorbing formation on each of said spokes on the side opposite the type carrying side and directly opposite said types, said formations having a resilience related to the print area of associated type for absorbing an amount of hammer energy related to the spring area of a type thereby to obtain substantially uniform print density for all said type.

2. The combination recited in claim 1, said resilient energy absorbing formations comprising recesses of uniform depth and of varying area formed in the side of said spokes directly opposite the type on the type carrying side, and resilient means secured to said spokes and overlying said recesses for absorbing print hammer energy according to the area of said recesses.

3. The combination recited in claim 1, said energy absorbing formations on the sides of said spokes directly opposite the type on the type carrying side comprising V-notches in the ends of said spokes open to the outer periphery of said print wheel, said notches being of varying depth whereby the impact of said print hammer on one leg defining the V-notches will be resiliently absorbed in an amount related to the depth of the V-notch.

* * * * *

UNITED STATES PATENT AND TRADEMARK OFFICE

CERTIFICATE OF CORRECTION

PATENT NO. : 4,278,358

DATED : July 14, 1981

INVENTOR(S) : Peter Zahner et al.

It is certified that error appears in the above—identified patent and that said Letters Patent is hereby corrected as shown below:

Column 4, line 8, "pring" should read -- print --.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*